US012297710B2

(12) United States Patent
Infante

(10) Patent No.: US 12,297,710 B2
(45) Date of Patent: May 13, 2025

(54) SYSTEMS AND METHODS FOR RUNNING TUBULARS

(71) Applicant: Jairo Gutierrez Infante, Bogota (CO)

(72) Inventor: Jairo Gutierrez Infante, Bogota (CO)

(73) Assignee: Tubular Technology Tools LLC, Fulshear, TX (US)

( * ) Notice: Subject to any disclaimer, the term of this patent is extended or adjusted under 35 U.S.C. 154(b) by 0 days.

(21) Appl. No.: 17/639,466

(22) PCT Filed: Nov. 14, 2020

(86) PCT No.: PCT/IB2020/060729

§ 371 (c)(1),
(2) Date: Mar. 1, 2022

(87) PCT Pub. No.: WO2021/105812

PCT Pub. Date: Jun. 3, 2021

(65) Prior Publication Data

US 2022/0333449 A1 Oct. 20, 2022

Related U.S. Application Data

(60) Provisional application No. 62/940,756, filed on Nov. 26, 2019.

(51) Int. Cl.

| | |
|---|---|
| ***E21B 31/20*** | (2006.01) |
| ***E21B 19/07*** | (2006.01) |
| ***E21B 19/16*** | (2006.01) |

(52) U.S. Cl.

CPC ..... *E21B 31/20* (2013.01); *E21B 19/07* (2013.01); *E21B 19/16* (2013.01)

(58) Field of Classification Search

CPC ..... E21B 19/07; E21B 31/20

See application file for complete search history.

(56) References Cited

U.S. PATENT DOCUMENTS

| | | | |
|---|---|---|---|
| 881,496 | A | 3/1908 | Seaman |
| 1,441,583 | A | 1/1923 | Humason |

(Continued)

FOREIGN PATENT DOCUMENTS

| | | | | |
|---|---|---|---|---|
| CN | 107100559 | A * | 8/2017 | |
| WO | WO-2006116870 | A1 * | 11/2006 | ..... E21B 19/06 |
| WO | WO-2010006445 | A1 * | 1/2010 | ..... E21B 19/07 |

OTHER PUBLICATIONS

Written Opinion of the International Searching Authority, International Application No. PCT/IB2020/060729, dated Feb. 23, 2021.

(Continued)

*Primary Examiner* — Giovanna Wright
*Assistant Examiner* — Ronald R Runyan
(74) *Attorney, Agent, or Firm* — Victor H. Segura

(57) ABSTRACT

A tubular running tool equipped with a mandrel having an elongated body and configured for suspension above a wellbore. A plurality of slips are disposed on the mandrel. Each slip is configured to receive and hold a swappable insert via a releasable interlocking junction. Each swappable insert is configured with a gripping portion on an outer surface thereof. The mandrel is configured for actuation to urge the slips radially outward such that the swappable inserts disposed thereon are correspondingly urged radially outward. A method and system using the tool for running a tubular and providing a makeup torque.

20 Claims, 6 Drawing Sheets

(56) References Cited

U.S. PATENT DOCUMENTS

| | | | | |
|---|---|---|---|---|
| 1,843,537 | A | 2/1932 | Bickerstaff | |
| 2,184,681 | A | 12/1939 | Osmun | |
| 2,191,000 | A | 2/1940 | Thomas | |
| 2,769,655 | A | 11/1956 | Holmes | |
| 6,309,002 | B1 | 10/2001 | Bouligny | |
| 6,431,626 | B1 | 8/2002 | Bouligny | |
| 6,679,333 | B2 | 1/2004 | Canrig | |
| 6,732,822 | B2 | 5/2004 | Slack et al. | |
| 6,742,584 | B1 | 6/2004 | Nabors | |
| 6,920,926 | B2 | 7/2005 | Canrig | |
| 7,140,443 | B2 | 11/2006 | Nabors | |
| 7,377,324 | B2 | 5/2008 | Nabors | |
| 7,445,050 | B2 | 11/2008 | Nabors | |
| 7,770,654 | B2 | 8/2010 | Nabors | |
| 8,240,371 | B2 | 8/2012 | Nabors | |
| 8,893,772 | B2 | 11/2014 | Henderson | |
| 9,057,234 | B2 | 6/2015 | Nabors | |
| 10,954,736 | B2 | 3/2021 | Weatherford | |
| 2001/0042625 | A1 | 11/2001 | Appleton | |
| 2007/0261857 | A1* | 11/2007 | Kuttel | E21B 19/06 166/380 |
| 2009/0272543 | A1 | 11/2009 | Bouligny et al. | |
| 2011/0114308 | A1* | 5/2011 | Nikiforuk | E21B 19/07 166/380 |
| 2011/0132594 | A1 | 6/2011 | Slack | |
| 2019/0284894 | A1* | 9/2019 | Schmidt | E21B 23/01 |

OTHER PUBLICATIONS

International Search Report, International Application No. PCT/IB2020/060729, dated Feb. 23, 2021.

* cited by examiner

SYSTEMS AND METHODS FOR RUNNING TUBULARS

CROSS REFERENCE TO RELATED APPLICATIONS

Continuation of International Application No. PCT/IB2020/060729 filed on Nov. 14, 2020. Priority is claimed from U.S. Provisional Application No. 62/940,756 filed on Nov. 26, 2019. Both the foregoing applications are incorporated herein by reference in their entirety.

FIELD OF THE INVENTION

The present disclosure relates generally to methods and apparatus for manipulating tubulars, and more particularly, to techniques for running (e.g., hoisting, moving, and lowering) oilfield tubulars for disposal in a wellbore.

BACKGROUND

The drilling and completion of subsurface wells involves assembling drill strings and casing strings, each of which entail multiple elongated, heavy tubular segments. A drill string consists of individual sections of pipe which are threadedly engaged together as the string assembly is lowered into a wellbore. Typically, the casing string is provided around the drill string to line the wellbore after drilling the hole, to ensure the integrity of the wellbore. The casing string also consists of multiple pipe segments threadedly coupled together during disposal into the wellbore.

Conventional techniques for assembling drill strings and casing strings entail the use of tools coupled to top drive assemblies. Such tools include manipulators designed to engage a pipe segment and hoist the segment up into a position for engagement to another pipe segment so the tubular assembly can be disposed into a wellbore. While such conventional tools facilitate the assembly of drill pipe and casing strings, such tools suffer from shortcomings. One such shortcoming is that these tools are generally designed for use with pipe segments of a specific internal/external diameter. When different diameter pipe segments are used (as is often the case in well operations), the running tool requires replacement with another tool designed to handle the particular diameter of the pipe in use. This results in inefficiencies producing time delays, added costs, greater risk of personnel injury, and equipment logistic complexity.

Thus, a need remains for improved techniques to efficiently and effectively manipulate or run tubulars.

SUMMARY

According to an aspect of the invention, a tubular running tool includes a mandrel having an elongated body and configured for suspension above a wellbore. A plurality of slips are disposed on the mandrel. Each slip is configured to receive and hold a swappable insert via a releasable interlocking junction, wherein each swappable insert is configured with a gripping portion on an outer surface thereof. The mandrel is configured for actuation to urge the slips radially outward such that the swappable inserts disposed thereon are correspondingly urged radially outward.

According to another aspect of the invention, a method for running a tubular includes suspending a mandrel above a wellbore, the mandrel having an elongated body with a plurality of slips disposed thereon, each slip configured to receive and hold a swappable insert via a releasable interlocking junction, and each insert configured with a gripping portion on an outer surface thereof; disposing a section of the mandrel into an open end of a tubular; actuating the mandrel to urge the slips radially outward such that the gripping portion on the swappable inserts engages the inner surface of the tubular; suspending and moving the tubular with the mandrel to a desired location; and actuating the mandrel at the desired location to retract the slips to disengage the gripping portion on the swappable inserts from the inner surface of the tubular to release the tubular.

According to another aspect of the invention, a system for running a tubular includes a mandrel having an elongated body and configured for suspension above a wellbore. A plurality of slips are disposed on the mandrel. Each slip is configured to receive and hold a swappable insert via a releasable interlocking junction. Each swappable insert is configured with a gripping portion on an outer surface thereof. The mandrel is configured for actuation to urge the slips radially outward such that the swappable inserts disposed thereon are correspondingly urged radially outward.

BRIEF DESCRIPTION OF THE DRAWINGS

The following figures form part of the present specification and are included to further demonstrate certain aspects of the present disclosure and should not be used to limit or define the claimed subject matter. The claimed subject matter may be better understood by reference to one or more of these drawings in combination with the description of embodiments presented herein. Consequently, a more complete understanding of the present embodiments and further features and advantages thereof may be acquired by referring to the following description taken in conjunction with the accompanying drawings, in which like reference numerals may identify like elements, wherein:

DETAILED DESCRIPTION

The foregoing description of the figures is provided for the convenience of the reader. It should be understood, however, that the embodiments are not limited to the precise arrangements and configurations shown in the figures. Also, the figures are not necessarily drawn to scale, and certain features may be shown exaggerated in scale or in generalized or schematic form, in the interest of clarity and conciseness.

While various embodiments are described herein, it should be appreciated that the present invention encompasses many inventive concepts that may be embodied in a wide variety of contexts. The following detailed description of exemplary embodiments, read in conjunction with the accompanying drawings, is merely illustrative and is not to be taken as limiting the scope of the invention, as it would be impossible or impractical to include all of the possible embodiments and contexts of the invention in this disclosure. Upon reading this disclosure, many alternative embodiments of the present invention will be apparent to persons of ordinary skill in the art. The scope of the invention is defined by the appended claims and equivalents thereof.

Illustrative embodiments of the invention are described below. In the interest of clarity, not all features of an actual implementation are described in this specification. In the development of any such actual embodiment, numerous implementation-specific decisions may need to be made to achieve the design-specific goals, which may vary from one implementation to another. It will be appreciated that such a development effort, while possibly complex and time-consuming, would nevertheless be a routine undertaking for persons of ordinary skill in the art having the benefit of this disclosure.

Figure 1:
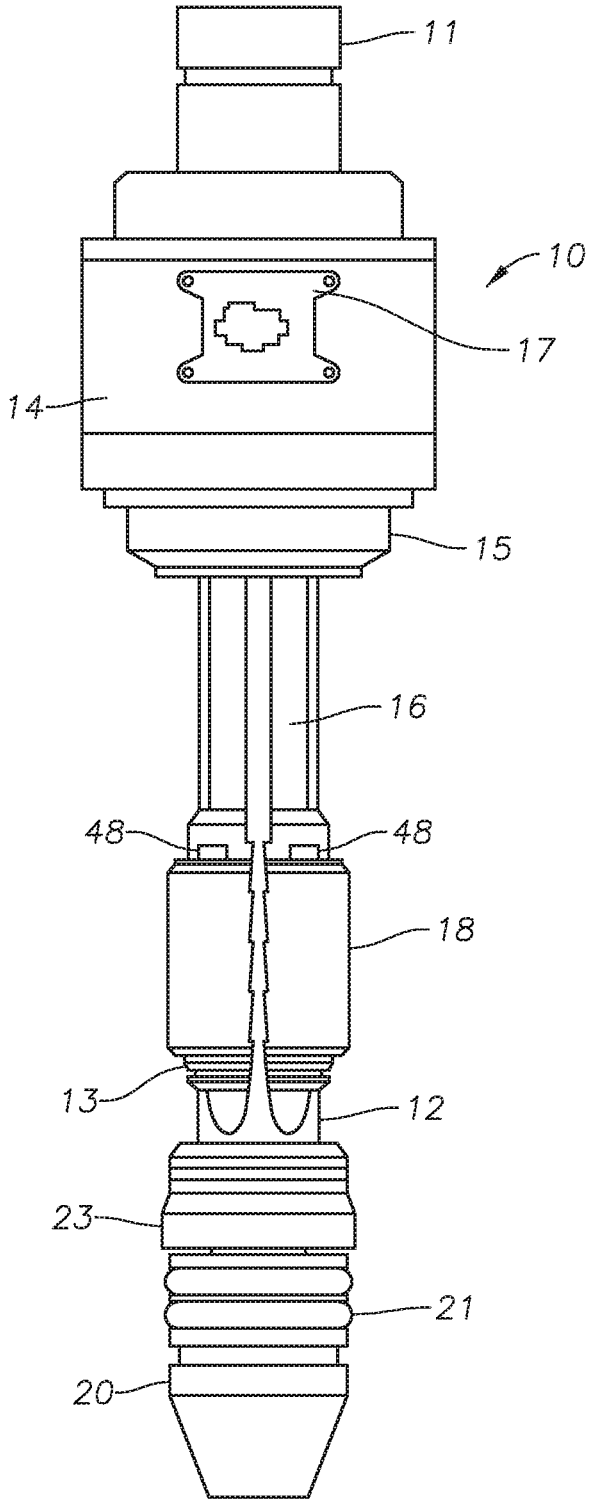
FIG. 1 shows a schematic of a tubular running tool according to an example of the present disclosure.

FIG. 1 shows a tubular running tool 10 embodiment of this disclosure. The tool 10 includes an elongated mandrel 12, an actuator 14, a number of slips 16 disposed on the mandrel, a number of swappable inserts 18 mounted on the slips, and a spear head 20 disposed at the distal end of the mandrel. The spear head 20 is elongated to support a series of O-rings 21 that assist to guide and center the mandrel 12 when the mandrel is inserted within a tubular, as described herein. Some spear head 20 embodiments may also be configured with a packer cup 23 at an upper end to provide sealing for the mandrel 12 when inserted within a tubular. The packer cup 23 also prevents fluids (e.g. drilling mud) from splashing out when fluids are pumped through the mandrel and into a connected tubular (further described herein). The packer may be formed of suitable rubber compounds as known in the art. As used herein, the term "swappable" means readily and easily removeable and replaceable as a single part or component.

Figure 2:
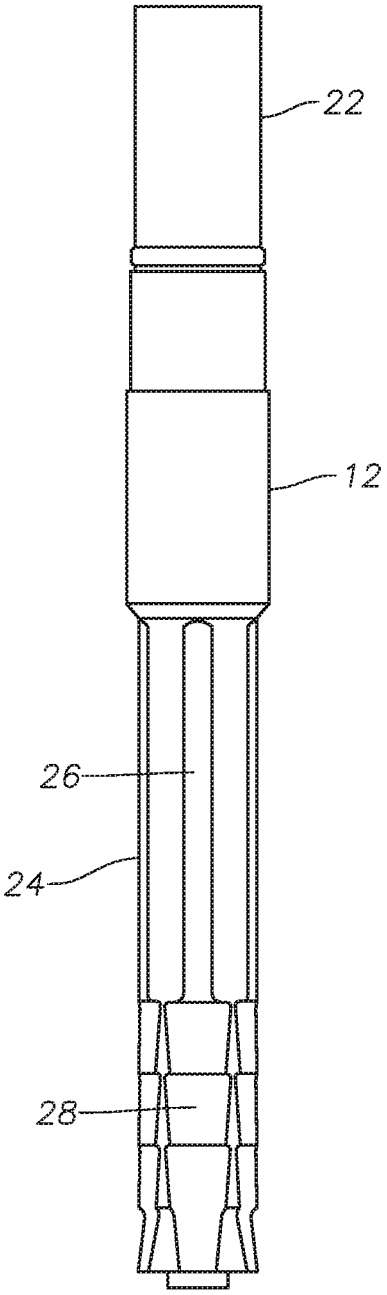
FIG. 2 shows a schematic of a mandrel according to an example of the present disclosure.

FIG. 2 shows an embodiment of a bare mandrel 12, without components disposed thereon. In one embodiment, the mandrel 12 is formed as a one-piece metallic (e.g. steel) tubular configured with an upper end 22 having a larger diameter compared to a stem 24 portion having a smaller diameter at an opposing end. As shown in FIG. 2, the stem 24 portion is configured with channels 26 running along the longitudinal axis of the mandrel 12. Mandrel 12 embodiments may be configured with one or more channels 26 formed therein. When multiple channels 26 are formed, they can be evenly spaced around the circumference of the tubular stem 24 portion and the number of channels may vary depending on the diameter of the mandrel 12 implementation. As shown in FIG. 2, each channel 26 is uniformly formed along a section of the stem 24 portion. As each channel 26 nears the end or tip of the stem 24 portion, the channel transitions into a plurality of stepped ramps 28 formed along the exterior of the mandrel 12 body.

Figure 3:
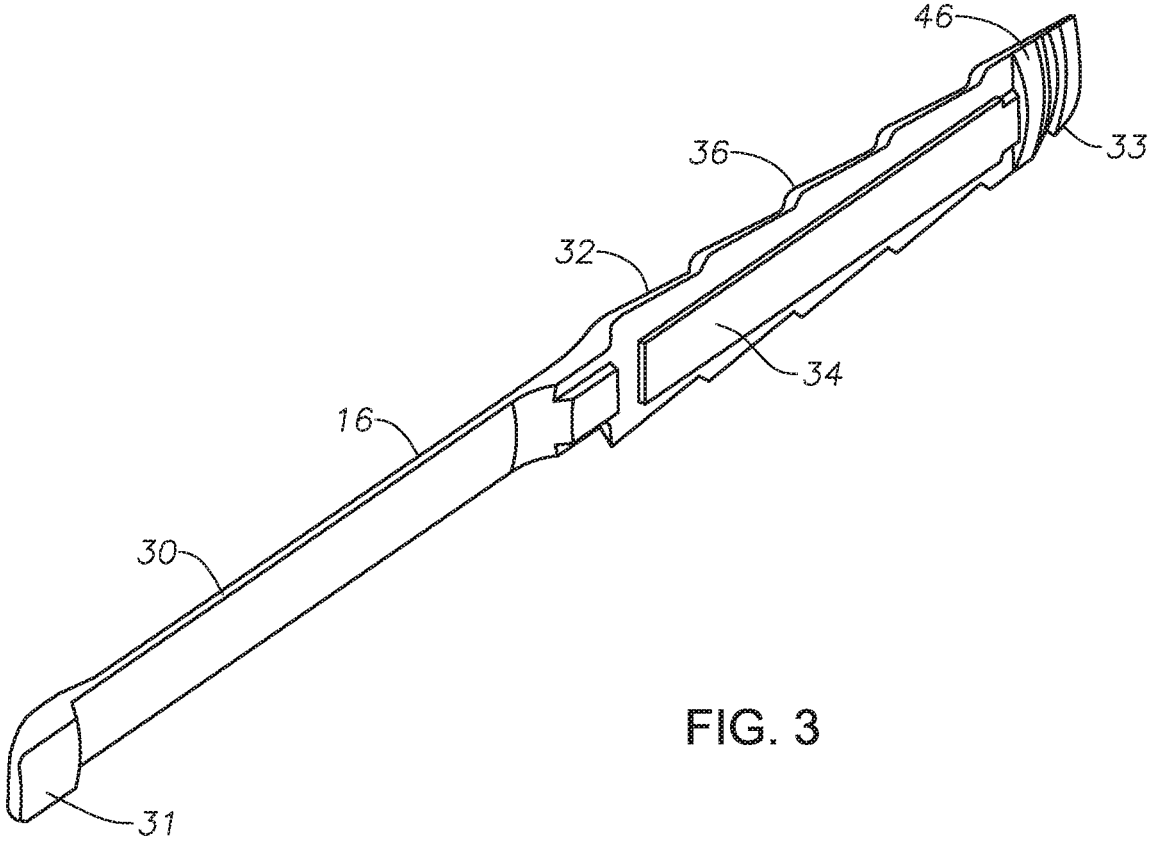
FIG. 3 shows a perspective view of a tool slip according to an example of the present disclosure.

FIG. 3 shows a slip 16 embodiment of this disclosure. The slip 16 is formed as an elongated blade structure having a narrow stem 30 portion at an upper end and a wider insert base 32 portion at a lower end. The narrow stem 30 portion of the slip 16 is configured to fit and reside within the channel 26 on the mandrel (see FIGS. 1 & 2). The distal end of the stem 30 portion has an elevation 31 that provides a retention shoulder for the slip at the upper end. A housing 15 adjacent to the actuator 14 (see FIG. 1) surrounds the upper end of the slips 16, preventing the slips from detachment from the tool 10 at the upper end. One surface of the insert base 32 portion includes a raised rail 34 formed thereon. The opposing surface or backside of the insert base 32 portion has a plurality of stepped ramps 36 configured for complementary engagement with the plurality of stepped ramps 28 formed on the exterior of the mandrel 12 body (further described below).

Figure 4A:
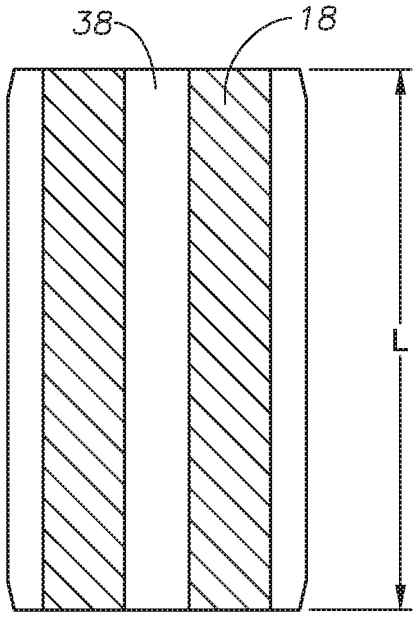
FIG. 4A shows a front view of a swappable insert according to examples of the present disclosure.
Figure 4B:
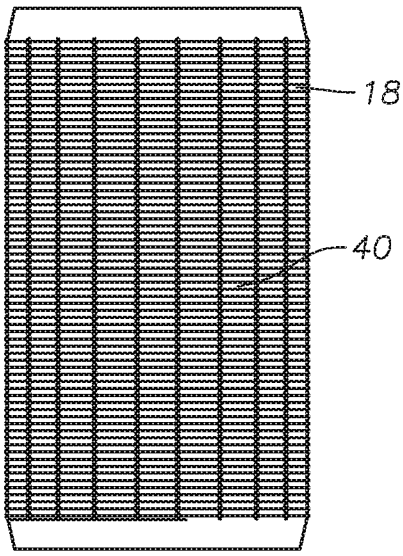
FIG. 4B shows another front view of the swappable insert of FIG. 4A.

FIG. 4A shows a front view of one side of a swappable insert 18 embodiment of this disclosure. Different insert 18 embodiments may be formed in different lengths L. FIG. 4A shows a side of the insert configured with a slot 38 running along its longitudinal axis. The slot 38 is configured to receive the raised rail 34 (see FIG. 3) when the insert 18 is mounted on the slip 16, as further described herein. The face of the insert 18 is generally smooth and planar. FIG. 4B shows the opposite side of the insert 18 of FIG. 4A. This side forms the outer surface of the insert 18 and is configured with a gripping portion 40 to provide an abrasive or non-smooth surface. The gripping portion 40 may be formed via conventional techniques as known in the art (e.g., knurled surface, layer deposition, chemical treatment, shot peening, etc.).

Figure 5:
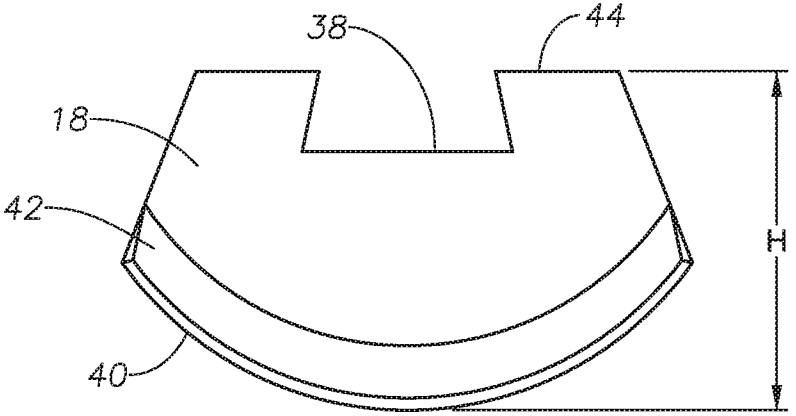
FIG. 5 shows an end view of an insert according to examples of the present disclosure.

FIG. 5 shows an end view of an insert 18 embodiment. The insert 18 is formed with a circular sector profile 42 having a selected height H as measured from a base 44 to the gripping portion 40 forming the outer surface (for example, but not to be limited to, between 5-13.5 inches (12.7-34.29 cm)). Conventional tubulars used in the oil and gas industry vary in internal diameter (ID) in relation to the weight of the tubular. Some operations require heavier weight pipe compared to other applications. The heavier the pipe, generally the thicker the wall of the pipe, and thus the variance in the ID of the different tubulars. It is also common in the industry to mix tubulars having different IDs in a single string during wellbore operations. The disclosed tools 10 allow one to quickly and easily swap inserts 18 in order to handle tubulars having different IDs without disruption to operations. By selecting a swappable insert 18 of a set height H, the overall mandrel 12 diameter can be easily altered and set as desired depending on the ID of the particular tubular to be run. As shown in FIG. 5, one embodiment may be formed with the slot 38 (see FIG. 4A) formed in a dovetail configuration. With such insert 18 embodiments, a slip 16 configured with a matching dovetail-profile raised rail 34 (see FIG. 3) will provide a conforming engagement for the swappable insert.

Figure 6:
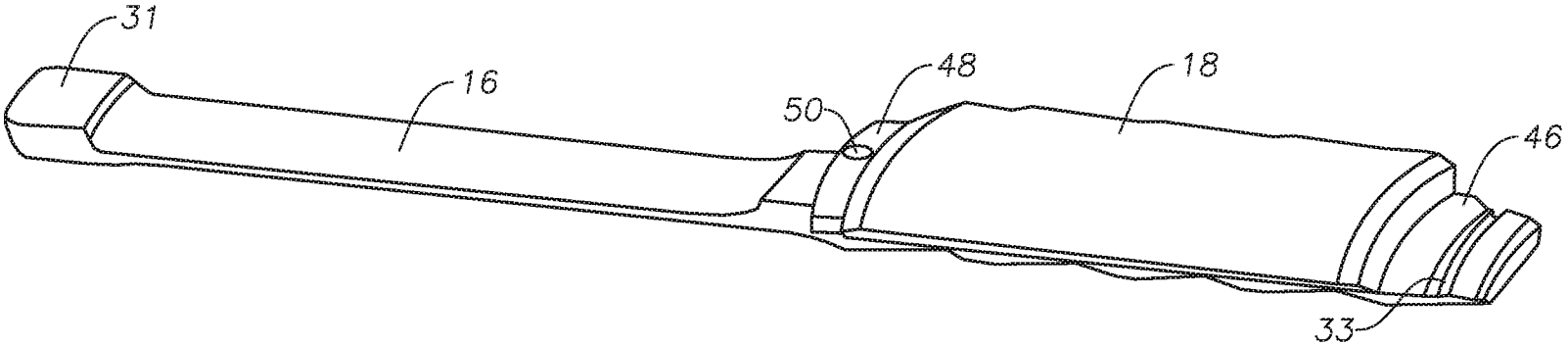
FIG. 6 shows a perspective view of a tool slip with an insert according to an example of the present disclosure.

FIG. 6 shows an oblique view of a slip 16 having a swappable insert 18 mounted thereon. The insert 18 is disposed on the slip 16 by aligning the slot 38 to engage with the raised rail 34 on the insert base 32 portion (see FIG. 3). It will be understood that slots 38 and rails 34 on respective inserts 18 and slips 16 may be configured in any suitable releasable interlocking junction providing for rapid physical engagement (e.g., dovetail, half-moon with end lips, T-rail, spring loaded, etc.). In some embodiments, the swappable insert 18 is retained from sliding off the slip 16 by a raised ledge or shoulder 46 formed at the lower end of the slip. In some embodiments, a locking bracket 48 may be affixed via a bolt 50 (or other fastener means as known in the art) to the slip 16 above the insert 18 to secure the insert at the upper end.

By swapping out the inserts 18 on the slips 16 using inserts of a selected height H (as described with respect to FIG. 5), the overall diameter of the tool assembly can be set as desired so that the stem 24 portion of the mandrel 12 can be inserted into tubulars of various inside diameters. The inserts 18 can be interchanged on the slips 16 without having to remove the individual slips from the mandrel 12. In this manner, the tool 10 embodiments of this disclosure allow one to quickly and efficiently change the diameter of the tool mandrel 12 for use with tubulars of various IDs. For example, removal and replacement of the swappable inserts 18 is easily and rapidly performed by removing the locking bracket 48, sliding the original insert 18 off the rail 34, swapping in the replacement insert (e.g., an insert of a different height H for a different tubular ID) by sliding it onto the rail, and replacing the locking bracket—all done while the tool 10 remains coupled to a top drive 58 and suspended over the wellbore (see FIG. 9).

Figure 7:
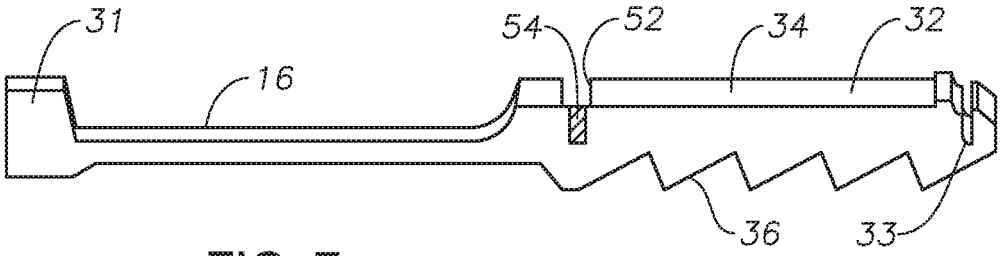
FIG. 7 shows a side view of a tool slip according to an example of the present disclosure.

FIG. 7 shows a cross-section of a slip 16 embodiment of this disclosure. The slip 16 includes a raised rail 34 running along one end of the slip along the insert base 32 portion. In some embodiments, a channel 52 may be formed near the upper end of the raised rail 34 to receive the locking bracket 48 (see FIG. 6). A threaded hole 54 may also be formed at the base of the channel 52 to receive the fastening bolt 50 to hold the locking bracket 48 in place (see FIG. 6). As shown in FIG. 7, one side of the slip 16 is configured with a series of stepped ramps 36 configured for complementary engagement with the plurality of stepped ramps 28 formed on the exterior of the mandrel 12 body (see FIG. 2). The lower tip of the slip 16 may be configured with a groove 33 to hold a spring 13 (see FIG. 1). Any suitable conventional spring 13 may be used (e.g. metallic toroidal spring).

Figure 8A:
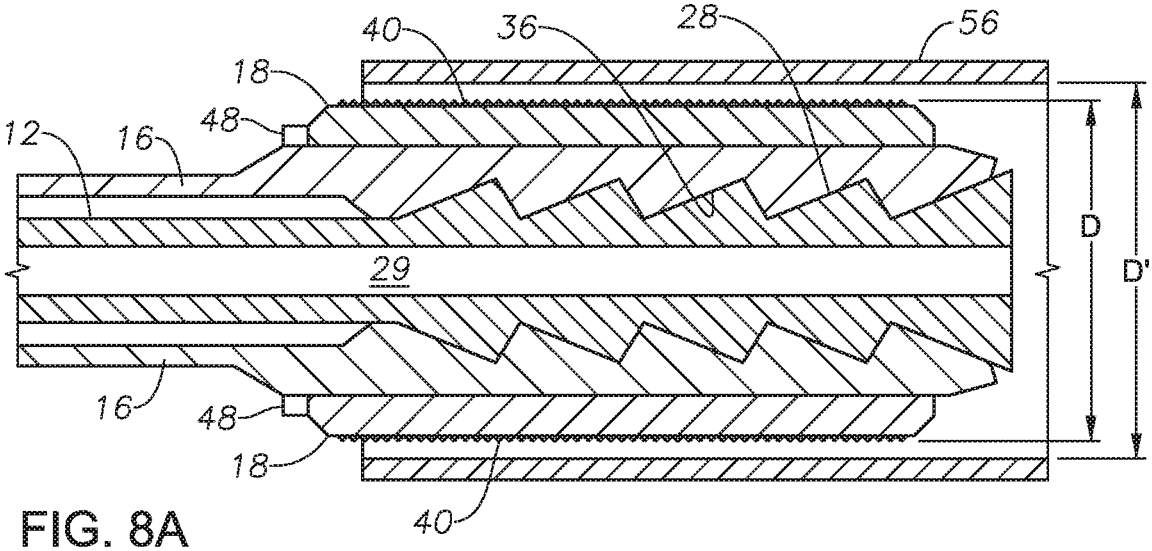
FIG. 8A shows a schematic of a mandrel in a neutral state within a tubular according to an example of the present disclosure.

FIG. 8A shows a cross-section schematic of a mandrel 12 assembly configured with a pair of slips 16 and inserts 18 disposed thereon. The end of the assembly is shown disposed in an open end of a tubular 56 having an inside diameter of D'. The assembly is inserted within the open end of the tubular 56 with the stepped ramps 36 of the slip 16 in complementary engagement with the stepped ramps 28 of the mandrel 12 in the neutral position. In the neutral position, the lands of the stepped ramps 28, 36 are mated in a low position such that the slips 16 lie close to the mandrel 12 body. In the neutral position, the overall tool assembly diameter is at a minimum D, which allows the tool to be disposed into the end of a tubular 56 of inner diameter D' (where D'>D).

Figure 8B:
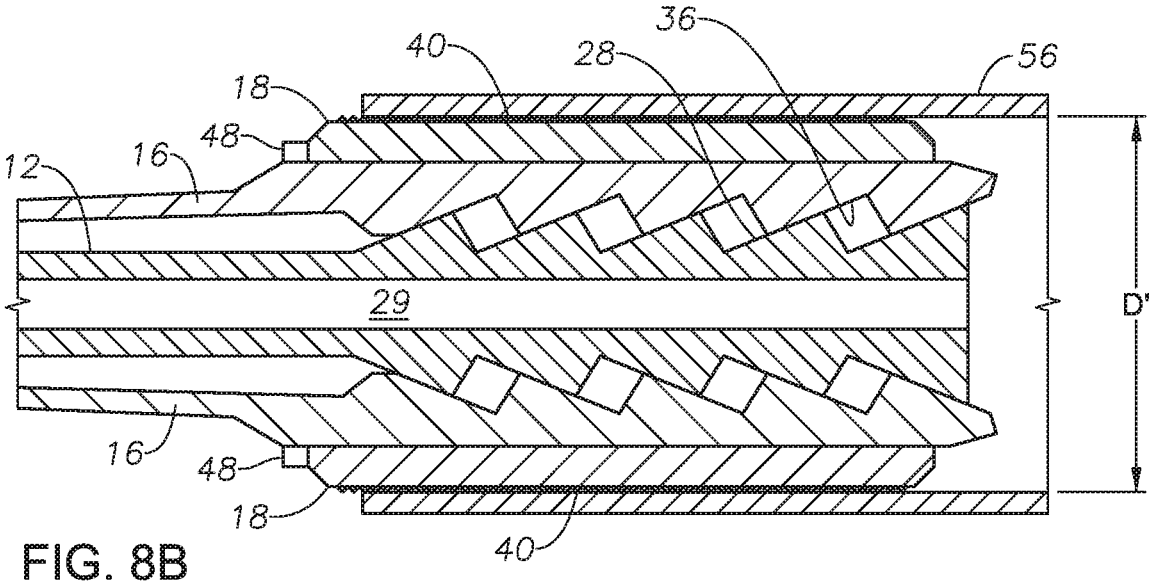
FIG. 8B shows a schematic of the mandrel of FIG. 8A in an actuated state within the tubular according to an example of the present disclosure.

FIG. 8B shows the assembly with the mandrel 12 moved axially (to the left in FIG. 8B), while the slips 16 remains stationary. As the mandrel 12 moves axially (e.g. up or towards the upper end of the tool 10), the stepped ramps 28 on the mandrel slide against the stepped ramps 36 of the slips 16. As depicted in FIG. 8B, as the peaks of the ramps 28 on the mandrel slide axially against the ramps 36 on the slip 16, the mandrel ramp peaks urge the slip ramps radially outwards. As the slips 16 expand radially outward, the swappable inserts 18 on each slip are correspondingly urged radially outwards so that the gripping portion 40 on the outer surface of each insert makes contact with and secures against the inner diameter surface of the tubular 56. Once the assembly is disposed in the open end of a tubular 56 as described herein, the tubular is securely engaged and can be manipulated (e.g., raised, suspended, transported, lowered, rotated and torqued in connection with another tubular, etc.) by movement of the assembly as desired.

The mandrel 12 is moved axially on the tool 10 via the actuator 14 (see FIG. 1). In some embodiments, the actuator 14 comprises a hydraulic mechanism with an internal valve 17 that can be activated to move the mandrel 12 in one axial direction or the other via hydraulic fluid pressure as known in the art. For example, the actuator 14 may be implemented with a conventional hydraulic pilot valve 17 allowing flow direction to be switched to actuate movement of the mandrel 12 as desired. As depicted in FIG. 8B, one embodiment of the tool 10 is configured such that when the actuator 14 moves the mandrel 12 upward or toward the upper end of the tool (to the left in FIG. 8B), the slips 16 are urged outward as described above, and when the mandrel moves downward or toward the lower end of the tool, the slips retract into the channels 26 on the mandrel. As previously discussed, a spring 13 may be disposed on the outer circumference of the slips 16 (see FIG. 1). With such embodiments, the spring 13 will provide tension to pull in the slips 16 toward the respective mandrel channels 26 when the actuator 14 is activated to allow the mandrel 12 to return to the neutral position as shown in FIG. 8A. In some embodiments, the actuator 14 may comprise an electromagnet configured with a conventional solenoid/spring mechanism coupled to the mandrel 12 to provide the axial motion. In other embodiments, the actuator 14 may comprise a conventional pneumatic piston-type mechanism coupled to the mandrel 12 to provide the axial motion.

Figure 9:
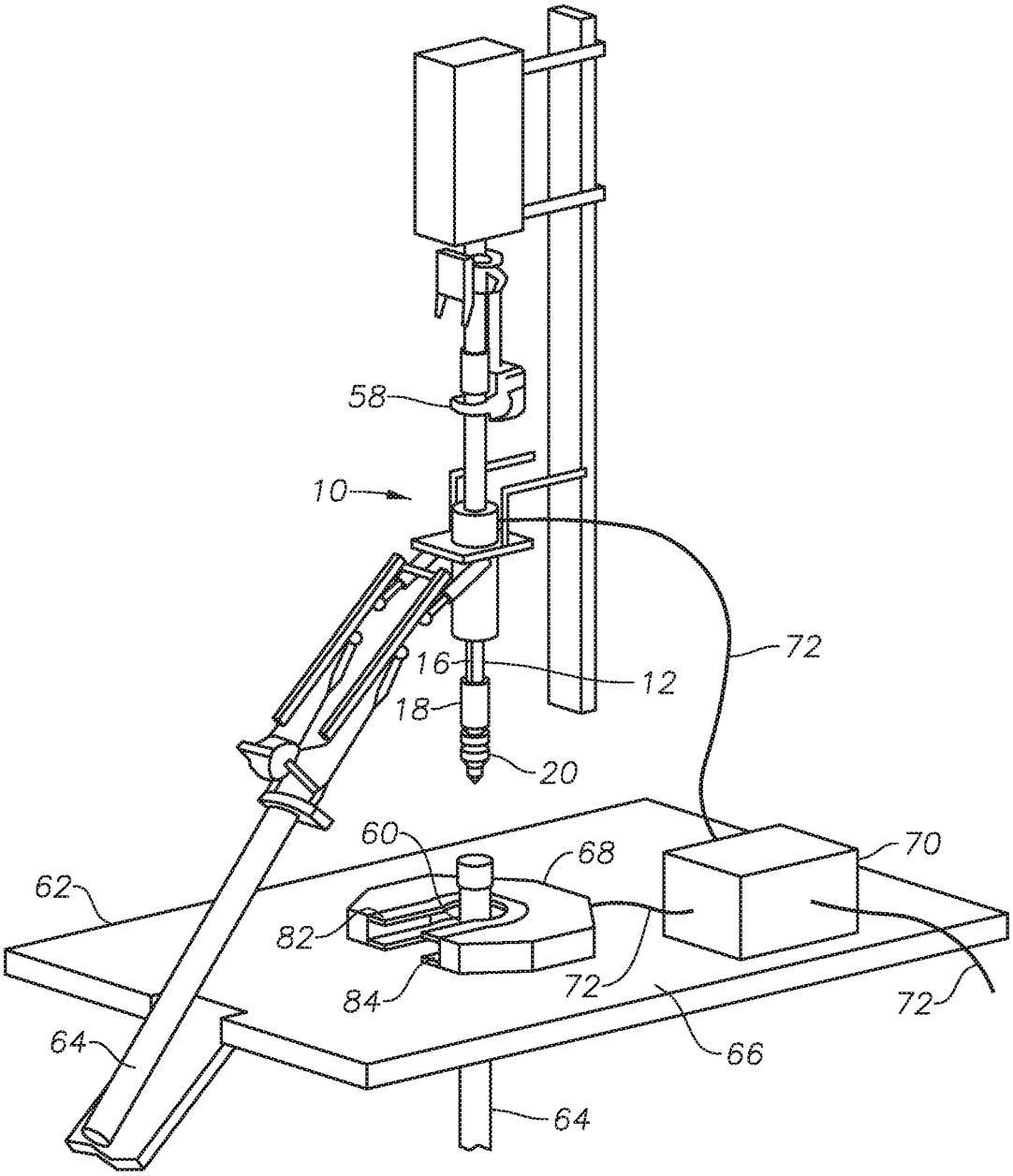
FIG. 9 shows a tubular running tool suspended over a wellbore in a rig operation according to examples of the present disclosure.

FIG. 9 shows a tool 10 embodiment coupled to a conventional top drive 58 and suspended above a wellbore 60 on a drilling rig 62. Embodiments may be implemented with the mandrel 12 having a standard box type connection (11 in FIG. 1) at the upper end for coupling with the top drive 58. The tool 10 is shown suspended above the wellbore 60. It will be appreciated that embodiments of the tool 10 may be used for land and offshore applications.

Once the tubular 64 is engaged by the tool 10 mandrel 12, it can be suspended and moved to the desired location on the rig floor 66 via movement of the top drive 58 as known in the art. In a typical application, the mandrel 12 will be used to engage a tubular 64 during the makeup of a tubular string on the rig floor 66. An advantage of the disclosed tools 10 is the ability to quickly and easily replace the swappable inserts 18 on the slips 16 to run tubulars 64 (e.g. casing tubulars, drill collars, etc.) of different internal diameters. Unlike conventional means for running tubulars (which use tools with fixed diameters that require unit disassembly and replacement of the entire tool when tubulars with different IDs are used), embodiments of the present disclosure provide the ability to quickly and easily swap the inserts 18 on the slips 16 to run different diameter tubulars, without having to disassemble the mandrel or disconnect the tool 10 from the top drive 58. Another advantage provided by the disclosed tools 10 is the ability to make up the tubular 64 connections (e.g. pin-box type connections) and provide rotational torque to the determined torque specifications of the pipe manufacturer.

FIG. 9 shows a C-plate platform 68 embodiment of this disclosure positioned over the wellbore 60. Embodiments of the platform 68 may be permanently fixed at a set location or they can be temporarily installed at a well site for use during specific operations and removed when the operations are completed. The platform 68 is configured to accept and hold the tubular 64 as it is disposed into or withdrawn from the wellbore 60. The platform 68 is configured with an upper guide plate 82 and a lower guide plate 84. Each guide plate 82, 84 may be swapped and replaced with a plate having a different size opening 74 (see FIGS. 10A, 10B) to accommodate tubulars having different outside diameters (ODs). FIG. 9 also shows a control module 70 configured with conventional conduits 72 (e.g. hoses, wiring harnesses) linked to the tool 10 and the platform 68 to provide fluids (e.g. hydraulic fluid, drilling mud), air pressure, electrical power, and/or signal communications under control of an operator.

In addition to providing rotational torque to the tubulars 64 (via the top drive 58) once the tubulars are engaged by the swappable inserts 18, the tool 10 embodiments of this disclosure also allow fluids, such as drilling mud, to be pumped into the tubulars 64 during make up of a string of drilling tubulars 64. The fluids may be conveyed to the top drive via the conduit 72 or other conduits coupled to the top drive as known in the art. The mandrel 12 embodiments are configured with an internal through bore (29 in FIGS. 8A, 8B) allowing the fluids to pass through the mandrel body and out through the spear head 20. In this manner, drilling mud pressure may be maintained within a string of drilling tubulars 64 as the tubular segments are manipulated by the tool 10.

Figure 10A:
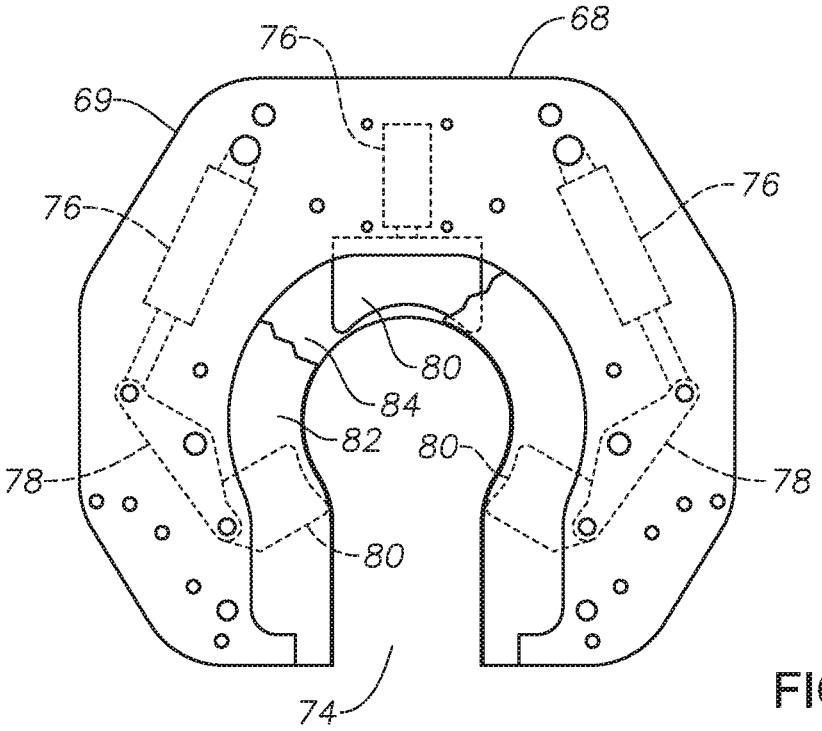
FIG. 10A shows a platform for retaining tubulars according to examples of the present disclosure.
Figure 10B:
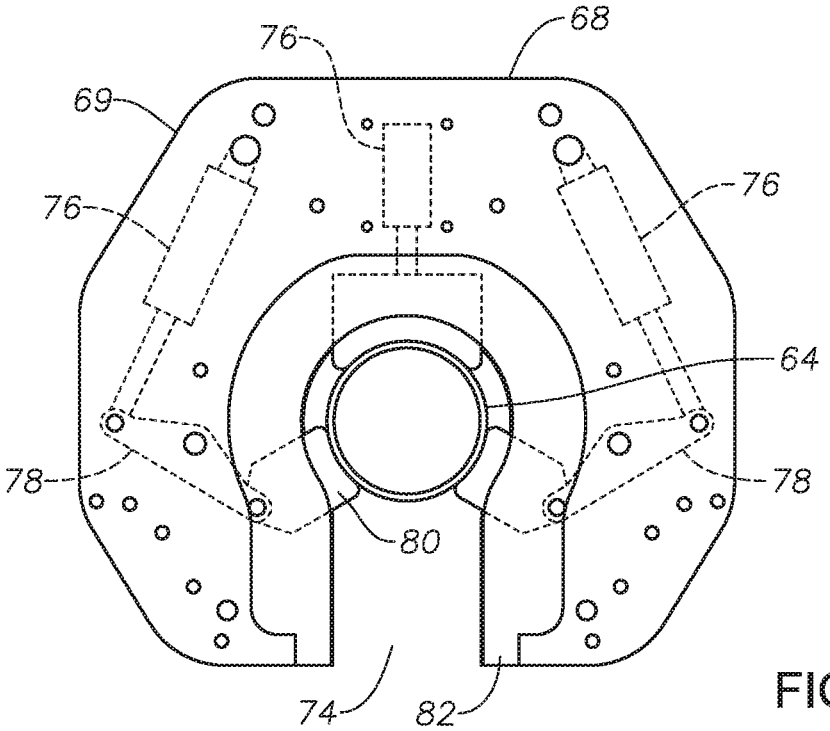
FIG. 10B shows the platform of FIG. 10A retaining a tubular according to examples of the present disclosure.

FIGS. 10A and 10B show an overhead view of a platform 68 embodiment of this disclosure. The platform 68 is configured with a body 69 having a substantially "C" shaped gap. As shown in the overhead views of FIGS. 10A and 10B, the swappable guide plates 82, 84 are disposed on the body 69 to provide a central opening 74 selected to accommodate and guide the particular tubular 64 used in the operation. A plurality of hydraulic cylinders 76 move articulated arms 78 to retract and extend jaws 80 to hold a tubular 64, as shown in FIG. 10B and in FIG. 9. FIG. 10A depicts a partial cutaway to expose the lower guide plate 84 and a section of a jaw 80. Platform 68 embodiments may be produced with different size bodies 69 and implemented with upper and lower guide plates 82, 84 correspondingly providing different size openings 74 to accept and hold tubulars with different ODs. The platforms 68 may be produced using suitable metals (e.g. steel) and hardware. Some embodiments may also be configured with interchangeable jaws 80 for use with particular tubulars 64 (e.g., tubulars with specialized connection geometries, special coatings, etc.). Some platforms 68 will vary in height and weight to accommodate cylinders 76, articulated arms 78, and housings of different sizes and tolerances depending on the weight to be suspended (e.g., some platforms 68 may be rated at 500 tons capacity). Embodiments of the platform 68 may also be transported for mobile use with the tools 10, or they may be configured for permanent installation and use as desired. It will be appreciated that embodiments of the platform 68 may also be used in other tubular handling operations; they are not limited for use solely above a wellbore.

In light of the principles and example embodiments described and depicted herein, it will be recognized that the example embodiments can be modified in arrangement and detail without departing from such principles. Also, the foregoing discussion has focused on particular embodiments, but other configurations are also contemplated. Even though expressions such as "in one embodiment," "in another embodiment," or the like are used herein, these phrases are meant to generally reference embodiment possibilities, and are not intended to limit the invention to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise.

This disclosure describes one or more embodiments wherein various operations are performed by certain systems, components, etc. In alternative embodiments, however, those operations could be performed by different components. It will be appreciated by those skilled in the art that embodiments may be implemented using conventional software and computer systems programmed to perform the disclosed processes and operations. It will also be appreciated by those skilled in the art that embodiments may be implemented using conventional hardware and electrical/mechanical components to provide the linkages, couplings, connections, communications, etc., in accordance with the techniques disclosed herein.

In view of the wide variety of useful permutations that may be readily derived from the example embodiments described herein, this detailed description is intended to be illustrative only, and should not be taken as limiting the scope of the invention. What is claimed as the invention, therefore, are all implementations that come within the scope of the following claims, and all equivalents to such implementations.

What is claimed is:

1. A tubular running tool, comprising:
a mandrel having an elongated body and configured for suspension above a wellbore;
a plurality of slips disposed on the mandrel;
each slip configured to receive and hold a swappable insert via a releasable interlocking junction;
wherein each swappable insert is configured with a gripping portion on an outer surface thereof;
a spear head coupled to one end of the mandrel and configured to guide the mandrel into an open end of a tubular at wellbore surface; and
wherein the mandrel is configured to actuation to urge the slips radially outward such that the swappable inserts disposed thereon are correspondingly urged radially outward to engage the open end of the tubular to permit manipulation of the tubular at the wellbore surface;
the manipulation of the tubular comprising suspension of the tubular over a platform having a plurality of powered articulated arms configured to extend and retract in a single horizontal plane to engage the tubular,
wherein each arm is linked to a jaw configured to engage the tubular to prevent rotation of the tubular.

2. The tool of claim 1 wherein:
the mandrel has a plurality of stepped ramps formed on the exterior of the body;
each slip has a plurality of stepped ramps configured for complementary engagement with the plurality of stepped ramps formed on the exterior of the mandrel body; and
wherein actuation of the mandrel in an axial direction urges each of the plurality of slips radially outward.

3. The tool of claim 1 wherein the mandrel is configured for rotation about a longitudinal axis of the elongated body to provide a determined torque.

4. The tool of claim 1 further comprising an actuator configured to actuate the mandrel to urge the slips radially outward.

5. The tool of claim 1 further comprising a spring to retain an end of the slips against the mandrel.

6. The tool of claim 1 wherein each swappable insert is configured with a circular sector profile such that an assembly of the inserts on the mandrel forms a tubular configuration having a pre-determined diameter.

7. The tool of claim 1 wherein the mandrel is configured with a through bore to permit fluid flow therethrough.

8. A method for running a tubular, comprising:

suspending a mandrel above a wellbore, the mandrel having an elongated body with a plurality of slips disposed thereon, each slip configured to receive and hold a swappable insert via a releasable interlocking junction, wherein each insert is configured with a gripping portion on an outer surface thereof;

disposing a spear head on the mandrel into an open end of a tubular at wellbore surface;

actuating the mandrel to urge the slips radially outward such that the gripping portion on the swappable inserts engages the inner surface of the tubular;

manipulating the tubular with the mandrel at the wellbore surface, wherein manipulating the tubular comprises suspending the tubular over a platform having a plurality of powered articulated arms configured to extend and retract in a single horizontal plane to engage the tubular, wherein each arm is linked to a jaw configured to engage the tubular to prevent rotation of the tubular; and actuating the mandrel at the well surface to retract the slips to disengage the gripping portion on the swappable inserts from the inner surface of the tubular to release the tubular.

9. The method of claim 8 further comprising mounting the swappable inserts on the slips to establish a desired external diameter for the assembly, each swappable insert having a pre-determined circular sector diameter.

10. The method of claim 8 wherein the mandrel is configured to torque the tubular engaged with the mandrel by rotating the tubular.

11. The method of claim 8 wherein the mandrel is configured with a plurality of stepped ramps formed on the exterior of the body, and each slip is configured with a plurality of stepped ramps configured for complementary engagement with the plurality of stepped ramps formed on the exterior of the mandrel body.

12. The method of claim 8 wherein the mandrel is configured for hydraulic actuation.

13. The method of claim 8 wherein the mandrel comprises a spear head configured to guide the mandrel into the open end of the tubular.

14. The method of claim 8 wherein the mandrel is configured with a through bore to permit fluid flow therethrough to the bore of the tubular engaged with the mandrel.

15. The method of claim 8 wherein manipulating the tubular further comprises inserting the tubular into the platform and/or withdrawing the tubular from the platform.

16. A system for running a tubular, comprising:

a mandrel having an elongated body and configured for suspension above a wellbore;

a plurality of slips disposed on the mandrel;

a plurality of swappable inserts configured for disposal on the slips, each insert being configured with a gripping portion on an outer surface thereof;

wherein each swappable insert is configured for attachment or detachment from the slip without removing the slip from the mandrel so an overall external diameter of the assembly of mandrel, slips, and inserts is readily alterable by swapping inserts on the slips;

a spear head coupled to one end of the mandrel and configured to guide the mandrel into an open end of a tubular at wellbore surface;

wherein the mandrel is configured for hydraulic actuation to urge the slips radially outward such that the swappable inserts disposed thereon are correspondingly urged radially outward to engage the open end of the tubular to permit manipulation of the tubular at the wellbore surface; and a platform configured with a plurality of powered articulated arms configured to extend and retract in a single horizontal plane to engage the tubular, wherein each arm is linked to a jaw configured to engage the tubular to prevent rotation of the tubular.

17. The system of claim 16 wherein the platform is configured for insertion and/or withdrawal of the tubular therefrom.

18. The system of claim 16 wherein the mandrel is configured with a through bore to permit fluid flow therethrough.

19. The system of claim 16 wherein the mandrel comprises a spring to retain an end of each of the slips against the mandrel.

20. The system of claim 16 wherein the mandrel is configured for rotation about a longitudinal axis of the elongated body to provide a determined torque.

* * * * *